US011511561B2

(12) United States Patent
Robinson

(10) Patent No.: US 11,511,561 B2
(45) Date of Patent: Nov. 29, 2022

(54) COLD SEAL PAPER APPARATUS AND METHOD FOR MANUFACTURING MAILPIECES

(71) Applicant: QUADIENT TECHNOLOGIES FRANCE, Bagneux (FR)

(72) Inventor: Peter Robinson, Essex (GB)

(73) Assignee: QUADIENT TECHNOLOGIES FRANCE, Bagneux (FR)

( * ) Notice: Subject to any disclaimer, the term of this patent is extended or adjusted under 35 U.S.C. 154(b) by 404 days.

(21) Appl. No.: 15/840,420

(22) Filed: Dec. 13, 2017

(65) Prior Publication Data

US 2018/0201051 A1 Jul. 19, 2018

(30) Foreign Application Priority Data

Jan. 13, 2017 (EP) ..... 17305043

(51) Int. Cl.

| | |
|---|---|
| ***B43M 3/04*** | (2006.01) |
| ***B65B 5/02*** | (2006.01) |
| ***B65B 51/28*** | (2006.01) |
| ***B65B 25/14*** | (2006.01) |

(52) U.S. Cl.

CPC ..... *B43M 3/04* (2013.01); *B65B 5/02* (2013.01); *B65B 25/145* (2013.01); *B65B 51/28* (2013.01)

(58) Field of Classification Search

CPC ..... B65B 25/14; B65B 57/04; B65B 5/04; B65B 11/48; B65B 11/004; B65B 49/00; B65H 2301/4318; B43M 3/045; B43M 3/04; B43M 5/04; B43M 5/042; B43M 5/045; B43M 5/047

USPC ..... 53/55, 203, 206, 235, 284.3, 381.5, 443, 53/460, 561, 569, 429, 447, 461, 466

See application file for complete search history.

(56) References Cited

U.S. PATENT DOCUMENTS

| | | | | | |
|---|---|---|---|---|---|
| 3,974,748 | A * | 8/1976 | Bethke | B65H 29/40 | 493/332 |
| 4,413,984 | A * | 11/1983 | Alter | B31B 70/00 | 493/222 |
| 4,939,888 | A * | 7/1990 | Katz | B65H 33/00 | 53/411 |
| 5,044,499 | A * | 9/1991 | Marion | B65B 9/02 | 206/438 |
| 5,155,973 | A * | 10/1992 | Hipko | B43M 5/04 | 53/450 |
| 5,197,262 | A * | 3/1993 | Katz | B65H 39/16 | 53/550 |

(Continued)

FOREIGN PATENT DOCUMENTS

| | | |
|---|---|---|
| EP | 1 693 184 A2 | 8/2006 |
| EP | 2 355 047 A1 | 8/2011 |

OTHER PUBLICATIONS

European Search Report, dated Jul. 7, 2017, for European Application No. 17 30 5043, 2 pages.

*Primary Examiner* — Andrew M Tecco
*Assistant Examiner* — Jacob A Smith
(74) *Attorney, Agent, or Firm* — Cozen O'Connor

(57) ABSTRACT

Apparatus for manufacturing mailpieces, comprising a supply module for supplying cold seal paper to form an envelope body, a feeding module for collating documents to form the content to be inserted in the mailpiece, and a pair of finishing rollers for folding the envelope body around the content and sealing the mailpiece in a single finishing step.

13 Claims, 4 Drawing Sheets

(56) References Cited

U.S. PATENT DOCUMENTS 5,388,815 A * 2/1995 Hill ..... B42D 5/027 270/32
5,409,441 A * 4/1995 Muscoplat ..... B43M 5/04 493/220
5,524,421 A * 6/1996 Nauheimer ..... B43M 5/04 229/68.1
5,803,889 A * 9/1998 Littman ..... B29C 41/003 493/188
5,921,065 A * 7/1999 Slyster ..... B42D 5/026 493/187
5,938,880 A * 8/1999 Downing ..... B43M 5/047 156/290
6,053,855 A * 4/2000 Stenner ..... B42D 15/08 229/300
6,071,367 A * 6/2000 Petkovsek ..... B42D 15/08 156/227
7,096,643 B2 * 8/2006 Le Gallo ..... B43M 5/042 400/56
7,254,931 B2 * 8/2007 Stemmle ..... B43M 5/04 53/411
7,406,813 B2 * 8/2008 Sytema ..... B43M 5/042 270/58.06
8,256,194 B2 * 9/2012 Brown ..... B65D 27/00 53/460
8,544,242 B2 * 10/2013 Munneke ..... B65H 39/043 53/429
8,561,380 B2 * 10/2013 Casto ..... B43M 3/045 53/473
2002/0053184 A1 * 5/2002 Hook ..... B65B 59/003 53/396
2004/0114161 A1 * 6/2004 Stemmle ..... B43M 5/04 358/1.9
2004/0159405 A1 * 8/2004 Hsieh ..... B43M 5/047 156/442.1
2004/0250517 A1 * 12/2004 Hsieh ..... B43M 3/045 53/569
2005/0092440 A1 * 5/2005 Lindsay ..... B65H 45/144 156/442.1
2006/0218884 A1 * 10/2006 Sperry ..... B65B 9/02 53/450
2007/0227102 A1 * 10/2007 Prataiola ..... B29C 66/91231 53/479
2008/0096748 A1 * 4/2008 Antonevich ..... B65B 9/02 493/187
2010/0176186 A1 * 7/2010 Law ..... B65D 27/14 229/80
2010/0190629 A1 * 7/2010 Eijkelkamp ..... B65H 45/18 493/444
2011/0057377 A1 * 3/2011 Sakata ..... B43M 5/047 270/58.07
2011/0170925 A1 * 7/2011 Wiersma ..... B65H 39/043 400/76
2011/0192892 A1 * 8/2011 Van Gorp ..... B43M 3/04 229/314
2012/0004085 A1 * 1/2012 Smith ..... B65H 45/145 493/421
2012/0125985 A1 * 5/2012 Christensen ..... B31B 50/62 229/67.3
2012/0159899 A1 * 6/2012 Kawano ..... B43M 5/04 53/203
2012/0260605 A1 * 10/2012 Nozawa ..... G03G 15/6594 53/65
2013/0174515 A1 * 7/2013 Wakatabi ..... B43M 5/042 53/284.3
2013/0276966 A1 * 10/2013 Mikula ..... C09J 121/02 156/227
2013/0288871 A1 * 10/2013 Aoto ..... B43M 3/04 493/188
2014/0213424 A1 * 7/2014 Mazeiller ..... B65H 45/12 493/416
2014/0223860 A1 * 8/2014 Schmid ..... B65B 3/025 53/411
2015/0135642 A1 * 5/2015 Nakamura ..... B43M 5/047 53/377.4
2015/0274338 A1 * 10/2015 Kawano ..... B43M 3/04 53/556

* cited by examiner

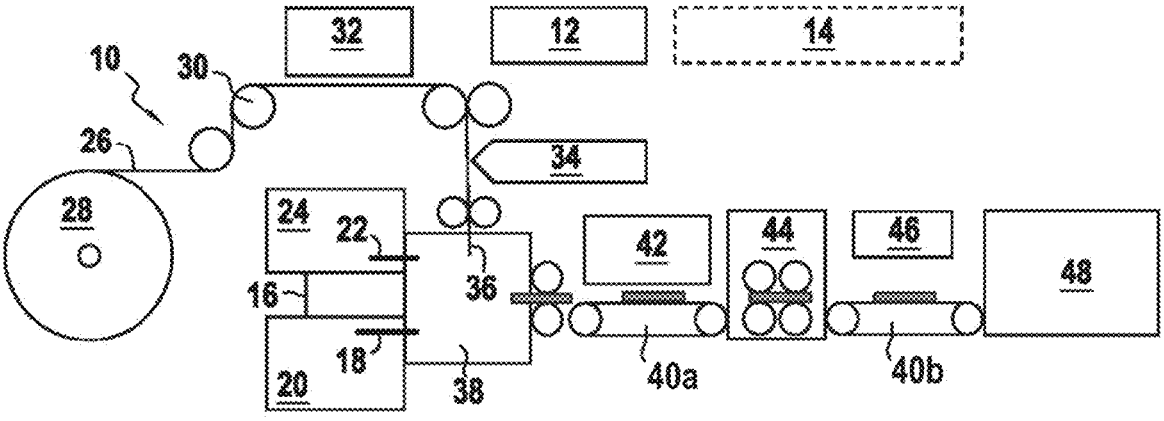
FIG.1
FIG.2
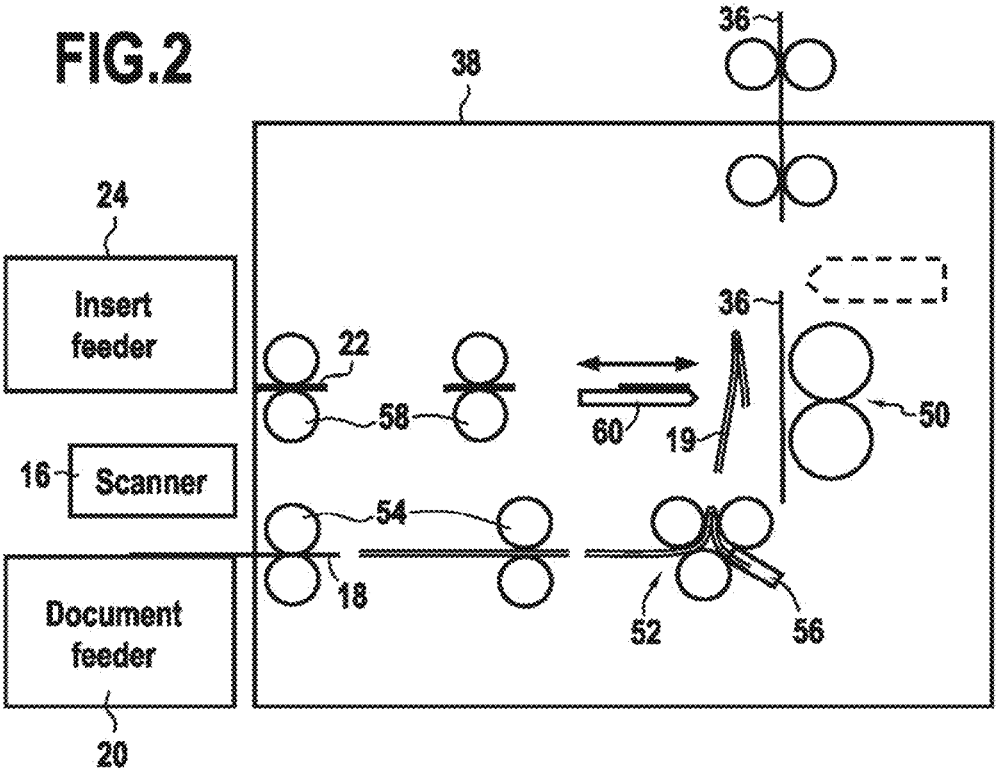
FIG.2A
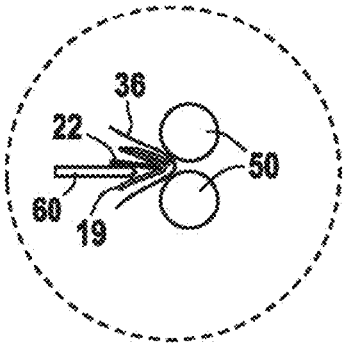

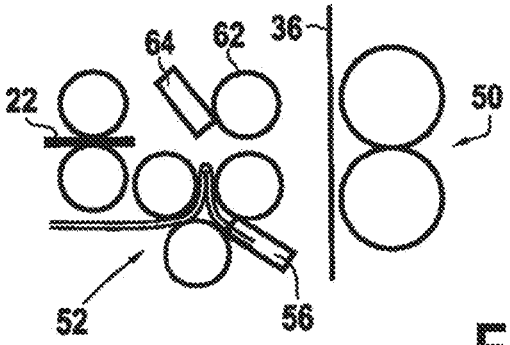
FIG.3
FIG.3D
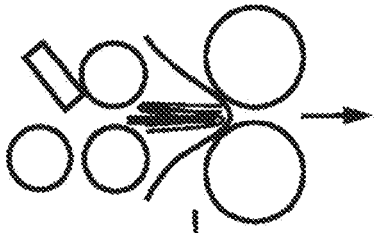
FIG.3C
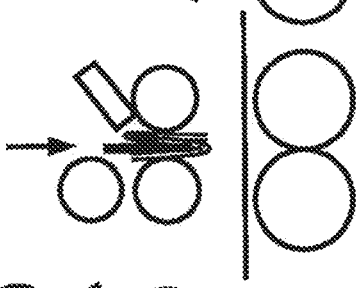
FIG.3B
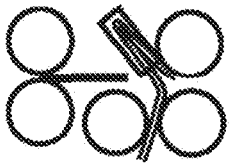
FIG.3A
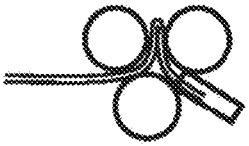
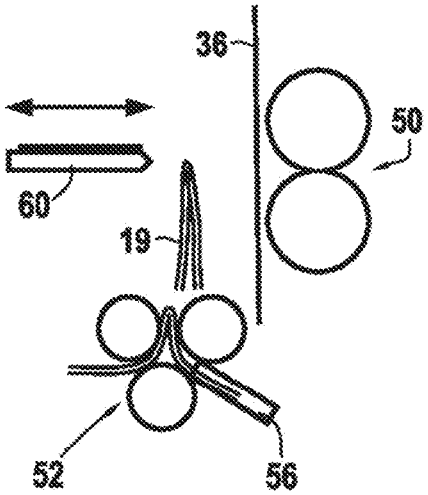
FIG.4A
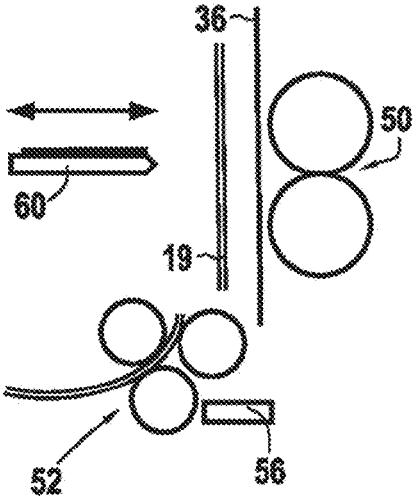
FIG.4B

COLD SEAL PAPER APPARATUS AND METHOD FOR MANUFACTURING MAILPIECES

TECHNICAL FIELD

The present disclosure relates to mail processing and customer communication, and notably to improvements in mail production systems incorporating notably paper handling machines used for folding and inserting documents and inserts into envelopes.

BACKGROUND

Despite a noticeable decrease in printed correspondence since the advent of Internet, physical mail remains a preferred and efficient communication channel for many customer segments. Letters have undoubtedly more substance than emails and a higher propensity to capture and retain customer attention. Modern output management technology allows the generation of highly personalized documents, but also to make them more interactive thanks to specific barcodes, such as a QR code, which behave as hyperlinks on paper. Another recent development in printed customer communication is the reverse envelope, which was recently authorized by the UPU (Universal Postal union) for bulk mailing. A reverse envelope resembles a normal envelope, except that the address window is on the flap side, along with postage and other marks used for Postal processing, leaving the opposite side fully available for customer communication or advertising. Mailers have thus more opportunities to capture customer's attention before the envelope is opened. On the other hand, customers are already used to heavily printed envelopes and may not even notice that these are reverse. Also the mail production process is complicated because the content of the envelope must be reversed before insertion. In many cases, this will result in an additional flip-over module.

The manufacturing of large batch of mail follows a number of operations. First, an output management system will receive data relative to a group of recipients from an enterprise application and prepare the documents intended for each individual customer. The system uses standard templates in which specific customer data are inserted, along with mailpiece identifiers and/or machine control instructions. A barcode symbol intended for interactive customer communication can be inserted at this stage. The batch of documents can then be virtually sorted according to the Postal distribution order, or split in various parts corresponding to different geographic areas, and/or to the capabilities of the local production equipment. Once all these operations have been performed, the batch of documents is printed.

Mailpiece identifiers and machine control instructions are used to trigger the operation of mail processing equipment at various stages of the manufacturing process, and notably insertion. There are indeed several modes of operating an inserter. In the simplest one, the job parameters are fixed and the same tasks are performed on all mailpieces. In a more elaborate mode, e.g., an open loop mode, each mailpiece bears control codes that are read and interpreted by the inserter. In the most sophisticated (e.g., data driven) mode, corresponding to a close loop mode, the mailpiece bears a unique identifier that points to a database where the finishing instructions for that particular mailpiece are recorded.

The finishing instructions of a mailpiece include the number of pages, eventually the fold type (C, Z or V fold) and a (larger) size of envelope, specific inserts that have to be added, and any information or image that needs to be printed on the envelope, including customer address. Indeed, some mailers prefer non-window envelopes for privileged customer communication. As the documents are fed into the inserter, mailpiece identifiers (ID's) and/or control codes are read by the machine, the various pages of the mailpieces are collated, folded and inserted into an envelope. Depending on their thickness or size, specific inserts may be added before or after folding. Envelope printing may take place before or after insertion. The inserter is typically a combination of modules corresponding to the successive operations of this process, each one having a variety of options. For instance, envelopes may be water-sealed just after insertion, the sealing module forming part of the inserting module. Scanners are used to read finishing instructions but also for integrity tracking purposes. A franking machine, a stacker or a sorting system may be added to the inserter to complete the manufacturing process.

A particular form of communication that has been existing for decades is called self-mailer. Self-mailers are pre-printed business forms which have adhesive or cohesive deposits that can be activated by pressure to produce a secure, tamper proof document. The main benefit of such forms is that they can carry public information externally and conceal confidential information internally when the form is simplex printed. Furthermore an addressee can immediately tell if the document has been opened by a third party by simple visual inspection. The adhesive or cohesive deposits are typically located on both sides of the document close to the document edges and in the proximity of regions of the form where fold lines will be made. A particular arrangement of cohesive deposits, together with the fold lines, dictates how the form is folded and sealed, and hence the quality of the seal and the level of security of the document.

U.S. Pat. No. 6,132,554 provides an example of an integrated system for folding, inserting, pressure sealing, delivering, and optionally separating into different jobs, self-mailer type business forms. A common housing mounted by wheels supports in, or on, it: a folder for folding paper sheets with pressure activated adhesive to form pre-mailers; an inserter for receipt of pre-mailers from the folder and for placing insert sheets into the pre-mailers; a conventional pressure sealer module for pressure sealing pre-mailers to form mailer type business forms; and a delivery device for delivering stacked forms horizontally out of a bottom portion of the housing.

GB2378154 describes an apparatus suitable for pressure sealing documents having a paper substrate, at least one fold line and a plurality of cohesive deposits, comprising means, such as rollers for applying a pressure to at least one edge of the folded document 1, which is less than 100 lbs per linear inch (1786 Kg per meter) light enough such that the cohesive bonds formed are weaker than the shear strength of the paper. In such a way, an envelope formed from the folded document might be opened without tearing the paper substrate, leaving a greater area for customer communication and allowing the document to be archived or reused.

The system of U.S. Pat. No. 6,132,554 is presumably capable of inserting single printed sheets, folded sheets, multiple sheet elements tied or affixed together, or even packets of material. It is however composed of numerous modules to prepare and feed the inserts separately from the self-mailer type business forms. The pressure sealing module itself is quite complex and requires typically 200 to 250 pounds per lineal inch. Although the pressure level is lower in the apparatus of GB2378154, its construction is also very stiff, complex and expensive. Notably, the folding of business forms and sealing are still separated functions. There is a need to provide a simpler apparatus for manufacturing mailpieces and a simpler method thereof.

SUMMARY

Embodiments of the invention can be summarized as a simpler apparatus for, and method of manufacturing mailpieces. More specifically, the apparatus and the method provide a much simpler and cost effective construction than traditional pressure sealers or inserters.

The apparatus than can accommodate a large variety of inserts, including single printed sheets, folded sheets and multiple sheet elements tied or affixed together, or even small items such as goodies or sweets.

Embodiments of the invention can be summarized as an apparatus and a method which do not use high pressure or water for the sealing of the mailpieces and that can accommodate a large variety of thicknesses and shapes for the content to be inserted.

The method for manufacturing mailpieces, comprising: supplying a piece of cold seal paper to form an envelope body; collating documents to form the content to be inserted in the mailpiece; folding the envelope body around the content and sealing the mailpiece in a single finishing step, act or operation.

The use of cold seal adhesives, which have been available for some time in the packaging industry, allows paper coated with these materials to be wrapped around an item, forming a protective barrier between the product and a shipping container box. Cold seal paper adheres to itself and not to the product being wrapped therein. Cold seal adhesives commonly contain natural rubber latex as the main ingredient and various additives, non-hazardous and having little or no volatile organic compounds, making them suitable for many applications, including incidental or permanent food contact. Cold seal paper is available in rolls of various weights and colours. The formed seal, although not completely secure, is strong enough for postal collection, sorting and distribution. The bond is maintained for several months and is compatible with marketing applications. Higher bond values can be achieved by particular formulations or a higher pressure used during the sealing process.

Advantageously, the piece of cold seal paper is cut from a roll feed according to desired dimensions of the mailpiece.

Preferably, the documents are collated in a document set composed of at least one document, and the envelope and the document set are folded together in the single finishing act or pre-folded before the single finishing act.

Advantageously, an insert is nested into the document set or added to the document set before the single finishing act.

Alternatively, the insert is collated and folded with the document set.

Advantageously, the document set is folded according to a Z, a C, or a V fold, depending on the number of pages or an insert type for a particular batch of mailpieces, or for a particular mailpiece.

Embodiments of the invention can be summarized as an apparatus for manufacturing mailpieces, comprising a supply module for supplying cold seal paper to form an envelope body, a feeding module for collating documents to form the content to be inserted in the mailpiece, and a pair of finishing rollers for folding the envelope body around the content and sealing the mailpiece in a single finishing act.

The apparatus of the invention features a combined folding and inserting unit. The envelope body is formed of a sheet of cold seal paper which is taken from a roll and cut to the appropriate size. A pre-folded document set is aligned with the envelope body and both are folded together. An insert or a small item can be added to the set just before folding. The folding pressure is low enough to accommodate a large variety of shapes for the content to be inserted; yet high enough to ensure a strong seal that can withstand the postal handling process.

The ability of the paper to only adhere to itself allows to form cold seal envelopes not adhering to the contained documents or inserts. Optionally, staples or eyelets can be affixed to the envelope for tamper detection.

BRIEF DESCRIPTION OF THE DRAWINGS

Various embodiments of the invention will be described and explained with additional specificity and detail through the use of the accompanying drawings in which:

FIG. 1 is a general schematic view of an apparatus according to an embodiment the invention;

FIG. 2 is a view of the folding and inserting module of an embodiment the invention;

FIG. 2A is a detailed view of the finishing rollers;

FIGS. 3, 3A, 3B, 3C, and 3D show an alternative embodiment of the folding and inserting module;

FIGS. 4A and 4B show alternative folding cycles of the folding and inserting module;

DETAILED DESCRIPTION OF EXEMPLARY EMBODIMENTS

Figure 5A:
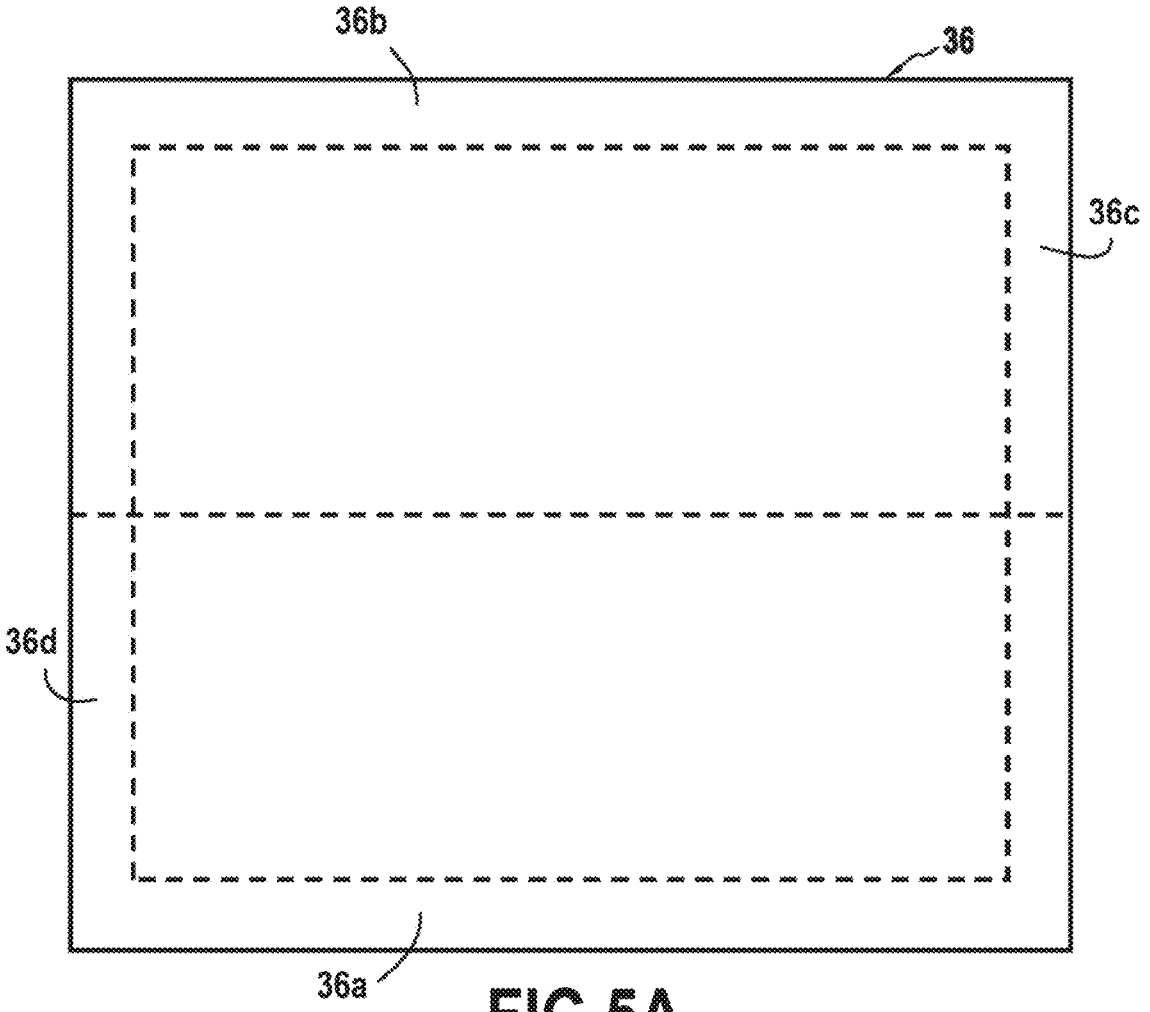
FIGS. 5A, 5B and 5C show at successive intervals of time an example mailpiece manufactured according to an embodiment the invention.

FIG. 1 is a general schematic view of an apparatus according to an embodiment of the invention. The apparatus 10 is controlled by a controller 12 (e.g., microprocessor, microcontroller, memory, storage media). In a preferred embodiment, the controller 12 may receive job data from an external output management system 14 and read with a scanner 16 mailpiece identifiers on documents 18 extracted from a document feeder 20. Otherwise the control unit may interpret directly control instructions printed on the documents as explained above. In any case, the controller 12 retrieves the finishing instructions related to each particular mailpiece. These finishing instructions include the number of pages, eventually the fold type (C, Z or V fold) and a (larger) size of envelope, specific inserts 22 that have to be added and extracted from an insert feeder 24, and any information or image that needs to be printed on the envelope, including customer address.

The cold seal paper 26 is supplied from a roll feed 28. Only the inner side of the paper is coated with cold seal adhesive material. The cold seal paper is unrolled by an unwinder 30. It will be appreciated that the inner side does not adhere to other materials but presents a significant grip, allowing an easy conveyance by conventional metal, rubber or plastic rollers. A blank piece of cold seal paper is fed under a printer 32 to print any desired information or image, and notably the customer address, under the control of the controller 12. The paper is then driven into a cutting module 34. The blank piece of cold seal paper now bearing the customer address is cut to form an envelope body 36 according to desired dimensions of the mailpiece and fed into a folding and inserting module 38. Otherwise it may be introduced in the folding and inserting module first, and then cut just before the folding cycle (see the module in dotted lines on FIG. 2).

Documents are extracted one by one from the document feeder 20 and then collated according to the number of pages of the particular mailpiece. The collation operation may take place in an intermediary module (not represented) or take place in the folding and inserting module 38, as a preliminary step of the folding cycle. In a preferred embodiment, once the document set 19 is completed, a first fold is initiated, such as to present the pre-folded document set in front of the envelope body 36. An insert 22 may be extracted from the insert feeder 24 and positioned in front of the document set. Then the document set, the insert and the envelope body are folded together, and a mailpiece is created and extracted from the folding and inserting module 38.

Additional operations may take place after the mailpiece is created. For instance, the mailpiece may be transported by a conveyor 40*a* under a second printer 42 to print additional information on the envelope, for instance a franking mark that must be applied to the mailpiece. It shall be appreciated that, unlike a standard envelope, there is no predefined plain of flap side. This offers a great flexibility in the way information and images can be laid out and printed. Alternatively, this second printer 42 may be the only one, and the printing of address and other desired information only happen after the mailpiece has been created. However, it is preferable to print all desired information before the folding and inserting module 38, when the paper is flat and well positioned. Indeed, the surface of the mailpiece may be uneven due to the shape of documents or inserts, necessitating a greater print distance and causing potentially poor print quality.

The apparatus may also include a binder (e.g., stapler) 44 to affix staples or eyelets to the mailpiece. Such elements are not required to maintain the integrity of the mailpiece, but serve as tamper detection means, by tearing off the paper if the envelope is opened before reaching the final recipient, which might be required if the content of the mailpiece is confidential. The staples or eyelets are preferably affixed on the edges of the envelope, in order to leave the content undamaged. Once all these operations have been completed, the mailpieces may be transported by the same or another conveyor 40B and checked out by a scanner 46 for integrity tracking purposes, and then transported to a staking module 48. Mailpiece ID's or addresses or tracking barcode that have been printed on the mailpieces are read by the scanner 46 and reported to the controller 12.

FIG. 2 is a detailed view of the folding and inserting module 38. FIG. 2A is a detailed view of the finishing rollers 50. The envelope body 36 separated from the roll feed 24 by the cutting module 34 is fed into the folding and inserting module 38. Alternatively, a cutter may be integrated in the folding and inserting module 38 and the cutting operation performed just before the folding cycle, as explained above. The envelope body is then positioned in front of a pair of finishing rollers 50 made of soft material. The terms "soft" is used herein to describe rollers that can accommodate a large variety of thicknesses and shapes for the content to be inserted. The hardness of the rollers is typically lower than 65° Shores A. Using a pair of soft finishing rollers, preferably opposite to each other, allows the creation of sensibly symmetrical mailpieces. However, if the application does not require it, a combination of a soft and a harder finishing roller may be used.

Documents 18 are extracted one by one from the document feeder 20 and then collated according to the number of pages of the particular mailpiece. In a preferred embodiment, once the document set 19 is completed, a first fold is initiated, by pushing the collated set into a first group of folding rollers 52 via transport rollers 54. The first group of folding rollers cooperates with a folding pocket 56 to perform a "buckle fold" in a manner well known in the art. The pre-folded document set is then positioned in front of the envelope body 36 facing the pair of finishing rollers 50. Inserts 22 are extracted from the insert feeder 24 and positioned by transport rollers 58 in front of the document set 19. In a preferred embodiment, an insert 22 is gripped by a folding knife 60. The folding knife moves back and forth along the direction indicated by the arrow, in order to push the pre-folded set and the envelope body 36 between the finishing rollers 20, so as to initiate a second fold. As the knife moves back to its initial position, the insert 22 is released and nested into the pre-folded set.

Then in a single finishing act, the document set, the insert and the envelope body are folded together, the content is inserted and simultaneously the mailpiece is sealed. The document set 19, the insert 22 and the envelope body 36 are shown in the dotted circle as they pass between the finishing rollers 50, after the insert has been released. The inner side of the envelope body adhere to itself, but not to the content. The finishing rollers 50 are soft enough to accommodate a large variety of thicknesses and shapes for the content to be inserted. A mailpiece is created and subsequently extracted from the folding and inserting module 38. The finishing rollers 50 are spring biased to apply a pressure of typically 4 to 10 lbs per linear inch on the envelope, thus significantly lower than the ones of conventional pressure sealers, in order to leave the content undamaged.

FIG. 3 shows an alternative embodiment of the folding and inserting module 38, along with the successive acts of the folding process. In this embodiment, the pre-folded set is used to initiate the final fold. The folding mechanism has instead of the folding knife 60 an additional folding roller 62 and an additional pocket 64 to form a Z fold in a manner well known in the art. An insert 22 can be nested into the pre-folded set when initiating the second fold. The successive acts of the folding process are illustrated on the right with, from bottom to top, FIG. 3A creating a first fold with the folding rollers 52 and the folding pocket 56, FIG. 3B nesting an insert and initiating a second fold with the additional folding roller and pocket 62, 64 too, FIG. 3C completing the second fold, and FIG. 3D folding the envelope body 36 around the content to be inserted and thus sealing the mailpiece. It shall be noted that an insert might not be required in a particular mailpiece. In this case, the folding acts a to d are identical, but no insert is nested and only the pre-folded set goes through the folding rollers 50 and is used as a folding knife to initiate the final fold (e.g., of the envelope body).

Alternative embodiments of the folding and inserting module 38 are also possible. For instance, inserts may be added to the document set during or just after collation, in order to be folded together. Adversely, inserts may be pre-folded separately before being nested in the document set. Instead of being nested, inserts may also be added on top of the folded document set before initiating the final fold. Instead of a Z fold, a C fold may also be created on the document set, by adapting the length of the first folding pocket in a manner well known in the art.

FIGS. 4A and 4B show alternative folding cycles of the folding and inserting module 38. The folding cycles previously described correspond to business letters of C5/6 or DL size. A larger C5 size of envelope may be required depending on the number of pages of the document set, with or without inserts being nested, of if an insert of A5 (or B5) size must be nested but cannot be folded. Then a longer piece of cold seal paper may be cut from the roll feed in order to create a larger envelope body. The folding and inserting module 38 of FIG. 2 can create a V fold on the document set 19, by adapting the length of the folding pocket 56 in a manner well known in the art, as illustrated in FIG. 4A. Alternatively, the folding pocket 56 may be disabled and the document set 19 pass through the folding rollers 50 without being folded, as illustrated in FIG. 4B. In a very particular embodiment not represented, there might be no folding rollers 52 to perform a first fold. In this case, the document set 19 is collated and then aligned with the envelope body 36, or a pre-cut envelope body is collated with the document set, and then the folding knife 60 initiates the final fold, with or without inserts being nested. This particular embodiment only requires the two finishing rollers 50 to create the mailpiece.

Figure 5B:
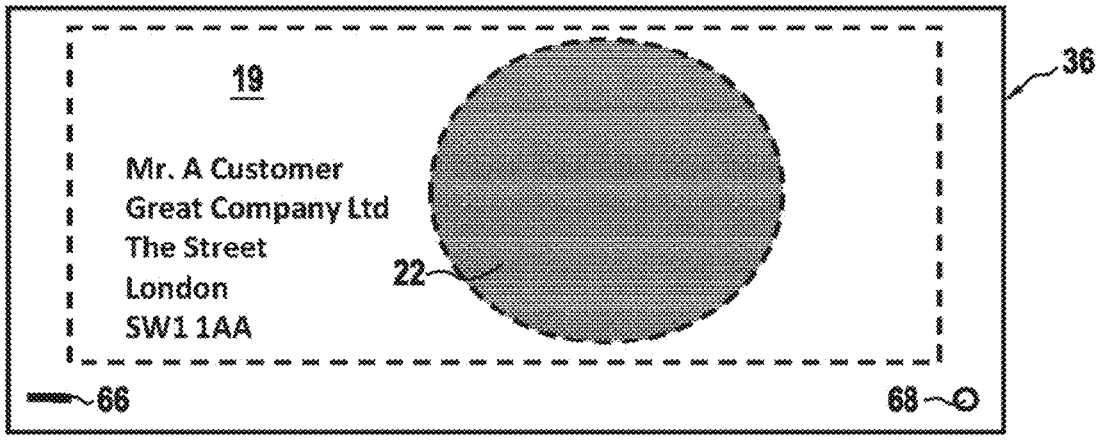
Figure 5C:
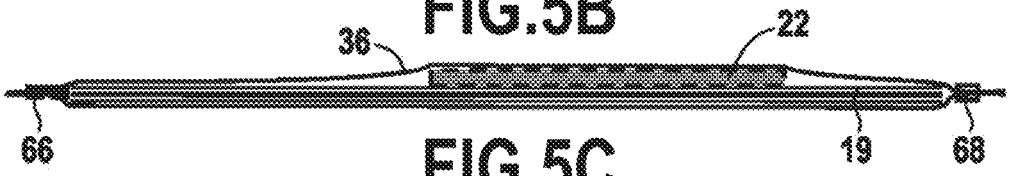

FIGS. 5A-5C show an example of mailpiece manufactured according to an embodiment of the invention. An unfolded two-flap envelope body 36 is illustrated in FIG. 5A. When the envelope body is cut, a margin 36*a*, 36*b* of approximately ½ inch or 1 cm is left at the bottom and top edges, with respect to the document set dimensions. The width of the cold seal paper roll is such that similar margins 36*c*, 36*d* are left on the lateral edges of the envelope body. These margins correspond to the area between the borders of the envelope body and the dotted square. The dotted square corresponds to twice the dimensions of the document set. The fold line corresponds to the dotted line in the middle of the envelope body before it is folded.

A complete and sealed mailpiece is illustrated in FIG. 5B with a folded envelope body 36 containing a document set 19 and an insert 22. The customer address is printed on the left side of the mailpiece. Any desired information or image is preferably printed before the envelope body is cut from the roll feed 28 as illustrated in FIG. 1, but may also be printed at a later stage. A franking mark, not represented, may also be part of the printed information. Preferably, the top edge of the mailpiece corresponds to the fold line of the envelope body, so that the document set and the inserts are close to the top. Staples 66 or eyelets 68 can be affixed to the bottom edge of the mailpiece without touching the content. Though only one of each has been represented, several staples or eyelets may be affixed all along the bottom and lateral edges of the mailpiece.

Depending on the thickness of the content a slightly longer piece of cold seal paper may be cut in any of the embodiments of FIGS. 2 & 3, 3A, 3B, 3C, 3D, 4A or 4B, in order to leave a margin at the bottom edge of the mailpiece sufficient to ensure a proper sealing and/or stapling.

A bottom view of the mailpiece is illustrated in FIG. 5C, showing the folded envelope body 36, the document set 19 and the insert 22 contained therein. The free area of the envelope body follows the contour of the content without the inner coated side of the cold seal paper adhering to the content. The cold seal paper only adheres on the edges where it has been pressed to itself by the finishing rollers 50. These finishing rollers are preferably made of a rubber material soft enough to accommodate a large variety of thicknesses and shapes for the content to be inserted. Other materials commonly used in the paper industry, such as EPDM of silicon may be used. During the folding cycle, the finishing rollers 50 deform along the insert lines in order to press the lateral and bottom edges of the mailpiece. The hardness of the rollers is preferably comprised between 15° and 65° Shores A. The pressure applied by the finishing rollers is typically of 4 to 10 lbs per linear inch, thus significantly lower than the ones of conventional pressure sealers, in order to leave the content undamaged. The pressure level can be increased to achieve higher bond values as allowed by the nature of the cold seal material. However, staples or eyelets can be added as tamper detection means if the content of the mailpiece is confidential.

Figure 6:
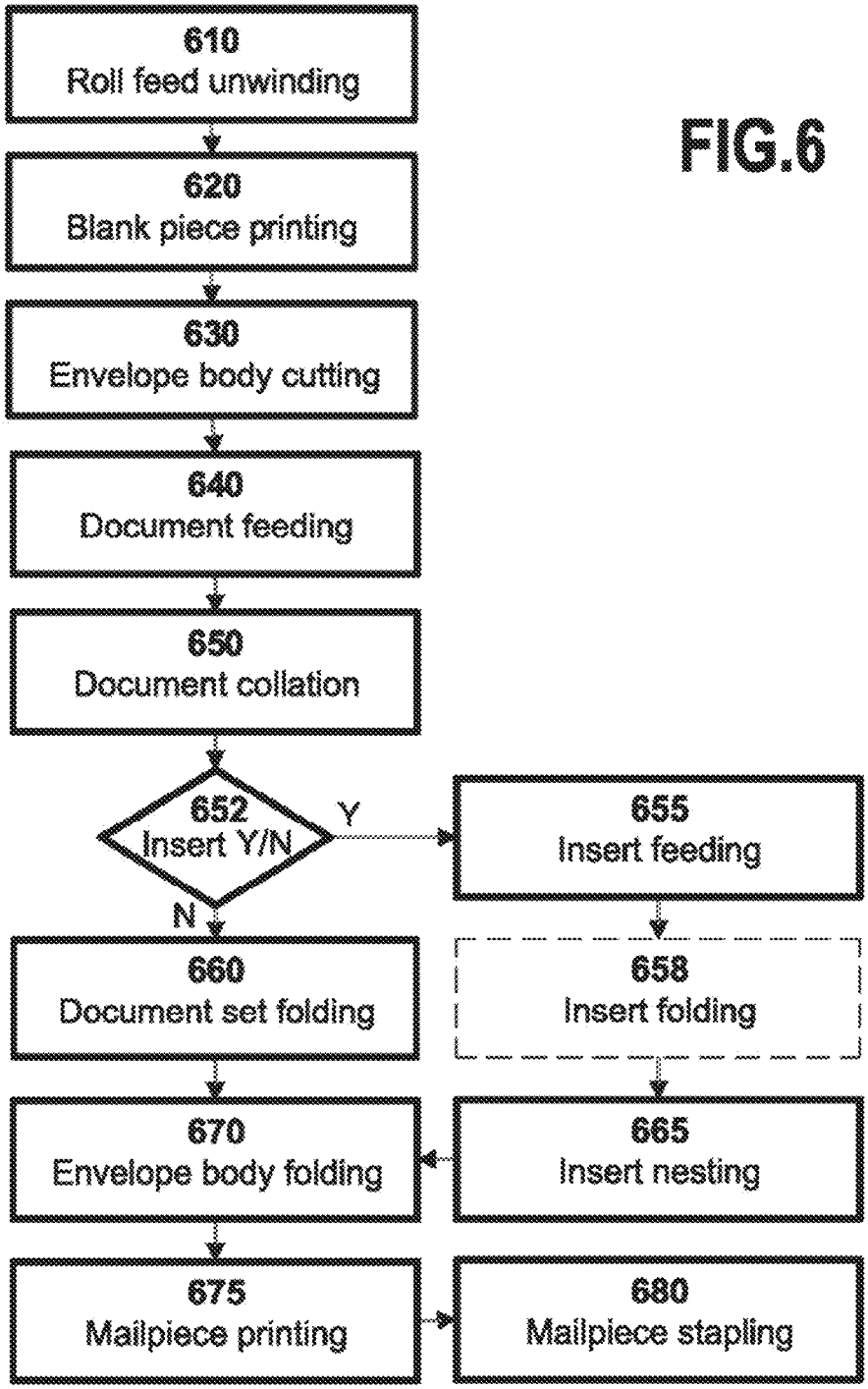
FIG. 6 is a flowchart showing the main acts of a method for practicing an embodiment the invention.

FIG. 6 is a flowchart showing the main acts or operations of a method for practicing an embodiment of the invention. All acts or operations may not be necessarily perform in the described order, and some acts or operations may be optional.

At 610, the cold seal paper 26 is unwound from the roll feed 28. It will be appreciated that the inner side does not adhere to other materials but presents a significant grip, allowing an easy conveyance by conventional metal, rubber or plastic rollers.

At 620 a blank piece of the cold seal paper is fed under the printing unit 32 to print any desired information or image, and notably the customer address.

At 630, the piece of cold seal paper bearing the customer address is cut to form an envelope body 36 according to the desired dimensions of the mailpiece and fed into the folding and inserting module 38. Cutting the envelope body may also be performed before printing, or adversely just before the folding cycle after introduction in the folding and inserting module.

At 640, documents are extracted one by one from the document feeder 20 and, at 650, collated according to the number of pages of the particular mailpiece. No collation is required if there is only one page. The collation may take place in an intermediary module or take place in the folding and inserting module 38, as a preliminary operation of the folding cycle.

At 652, it is determined whether an insert needs to be added to the document set. If the answer is yes, then an insert is fed from the insert feeder 24 at step 655, followed by the optional folding of the insert at step 658. It shall be noted that several insert feeders can be used if several insert types are required by the application, and the method is not limited to only one type of inserts and one insert feeder.

At 660, the document set is pre-folded and the insert is nested at 665. The insert may also be added on top of the folded set as described above. Depending on the configuration of the folding and inserting module 38, the document set may be only pre-folded, or not folded at all and just positioned in front of the envelope body 36.

At 670, the document set 19, the insert 22 and the envelope body 36 are folded together, a mailpiece is created and simultaneously sealed as the inner side of the envelope body adhere to itself. The mailpiece is subsequently extracted from the folding and inserting module 38.

At 675, additional information such as a franking mark is printed on the mailpiece by the second printing module 42. This second printing module may be the only one, and the printing of address and other desired information only happen after the mailpiece has been created.

At 680, staples or eyelets are affixed to the mailpiece by the stapling module 44. Such elements are not required to maintain the integrity of the mailpiece, but serve as tamper detection means, by tearing off the paper if the envelope is opened before reaching the final recipient, which might be required if the content of the mailpiece is confidential. The staples or eyelets are preferably affixed on the edges of the mailpiece, in order to leave the content undamaged. The terms "stapling", "staples" or "eyelets" are used in a broad sense to designate all kinds of fixtures which may be used to tie the two flaps of the envelope body, in addition to the adhesive material.

Additional acts or operations, such as scanning for integrity tracking purposes or stacking of the mailpieces can be added without departing from the spirit of the invention. Alternative method acts are possible. For instance, inserts may be added to the document set during or just after collation, in order to be folded together. Adversely, inserts may be pre-folded separately before being nested in the document set. Instead of being nested, inserts may also be added on top of the folded document set before initiating the final fold. Instead of a Z fold, a C or a V fold may be created on the document set, by adapting the length of the first folding pocket in a manner well known in the art, or no fold at all by bypassing the first folding act. The fold type may also depend on the number of pages or the insert type for a particular batch or mailpieces, or for a particular mailpiece, and vary within the manufacturing of the batch of mailpieces.

Although the apparatus 10, and notably the folding and inserting module 38, have been represented in a certain orientation with the mailpiece leaving in a sensibly horizontal manner for better understanding, other embodiments are possible. For instance, a pre-cut envelope body 36 may be printed and collated with the document set, with appropriate margins left on all sides, and the whole set pushed downwardly between the finishing rollers 50, with or without an insert being nested. Adaptations and variations of the apparatus and method can be considered without departing from the spirit of the invention, which is reflected in the appended claims.

The invention claimed is:

1. A method for manufacturing mailpieces, the method comprising:

supplying a piece of cold seal paper to form an envelope body;

collating documents to form content to be inserted in the mailpiece;

folding the envelope body around the content along a fold line corresponding to a middle of the envelope body with a pair of finishing rollers and simultaneously sealing the mailpiece with the pair of finishing rollers in a single finishing step.

2. The method for manufacturing mailpieces according to claim 1, wherein the piece of cold seal paper is cut from a roll feed according to desired dimensions of the mailpiece.

3. The method for manufacturing mailpieces according to claim 1, wherein the documents are collated in a document set composed of at least one document, and including folding the envelope and the document set together in the single finishing step.

4. The method for manufacturing mailpieces according to claim 3, wherein collating documents includes collating an insert with the document set.

5. The method for manufacturing mailpieces according to claim 3, including folding the document set according to a Z, a C, or a V fold, depending on the number of pages or an insert type for a particular batch of mailpieces, or for a particular mailpiece.

6. The method for manufacturing mailpieces according to claim 1, wherein the documents are collated in a document set composed of at least one document, and further comprising pre-folding the document before the single finishing step.

7. The method for manufacturing mailpieces according to claim 1, including nesting an insert into the document set before the single finishing step.

8. The method for manufacturing mailpieces according to claim 1, including adding an insert to the document set before the single finishing step.

9. The method for manufacturing mailpieces according to claim 1, wherein folding the envelope body around the content includes forming only one fold line, and the envelope body of the sealed mailpiece includes only one fold line.

10. The method for manufacturing mailpieces according to claim 1, wherein simultaneously sealing the mailpiece with the pair of finishing rollers includes simultaneously sealing a first portion of the envelope body and a second portion of the envelope body such that the content is positioned between and separates the first portion from the second portion.

11. A method operation of an apparatus to produce mailpieces, the method comprising:

collating documents to form content; and folding a piece of cold seal paper directly around the content along a fold line corresponding to a middle of the cold seal paper by a set of rollers to form an envelope body and simultaneously sealing the mailpiece by the set of rollers in a single finishing operation performed by the set of rollers.

12. The method of operation according to claim 11 wherein folding the piece of cold seal paper directly around the content includes forming only one fold line, and the envelope body of the sealed mailpiece includes only one fold line.

13. The method of operation according to claim 11 wherein simultaneously sealing the mailpiece with the pair of finishing rollers includes simultaneously sealing a first portion of the cold seal paper and a second portion of the cold seal paper such that the content is positioned between and separates the first portion from the second portion.

* * * * *